US005190184A

United States Patent [19]

Lechner

[11] Patent Number: 5,190,184

[45] Date of Patent: Mar. 2, 1993

[54] PRESSURE CONTAINER FOR GASES, LIQUIDS, PASTE-LIKE MATERIAL OR SIMILAR PRODUCTS

[75] Inventor: Rudolf Lechner, Singen, Fed. Rep. of Germany

[73] Assignee: Ladoco AG, Zug, Switzerland

[21] Appl. No.: 907,375

[22] Filed: Jul. 1, 1992

[30] Foreign Application Priority Data

Jul. 2, 1991 [DE] Fed. Rep. of Germany ..... 4121857

[51] Int. Cl.[5] ..... B65D 35/28

[52] U.S. Cl. ..... 220/581; 220/506; 220/723; 220/255; 222/386.5

[58] Field of Search ..... 220/723, 461, 581, 722, 220/720, 728, 585, 202, 203, 89.1, 915, 255, 560; 222/386.5, 387

[56] References Cited

U.S. PATENT DOCUMENTS

| | | | |
|---|---|---|---|
| 2,583,062 | 1/1952 | Ribovd | 220/722 |
| 3,145,884 | 8/1964 | Everett | 220/723 |
| 3,767,078 | 10/1973 | Gortz et al. | 220/723 |
| 3,883,046 | 5/1975 | Thompson et al. | 222/386.5 |
| 4,136,802 | 1/1979 | Mascia et al. | 220/723 |
| 4,185,758 | 1/1980 | Giggard | 220/461 |
| 4,213,545 | 7/1980 | Thompson et al. | 220/723 |
| 4,264,018 | 4/1981 | Warren | 220/723 |
| 4,271,869 | 6/1981 | Weidl et al. | 220/722 |
| 4,344,458 | 8/1982 | Zahid | 220/723 |
| 4,548,321 | 10/1985 | Mockesch et al. | 220/461 |

*Primary Examiner*—Joseph Man-Fu Moy

*Attorney, Agent, or Firm*—Tarolli, Sundheim & Covell

[57] ABSTRACT

A pressure container suitable for gases, liquids, paste-like materials or similar products comprises two chambers sealed against each other. One of the chambers is constituted by a flexible bag connected to a valve plate common to both chambers. The valve plate is provided with an extension tube extending into the interior of the container. A neck portion of the flexible bag is glued or welded to the extension tube. The outer contour of the extension tube comprises radially extending projections which are bounded by two outer faces each, and which, at their inner ends, merge tangentially into the circle-shaped contour of said first extension tube means and converge into a sharp edge at their outer ends. In this way, a reliable sealing of the two chambers against each other can be achieved.

8 Claims, 2 Drawing Sheets

PRESSURE CONTAINER FOR GASES, LIQUIDS, PASTE-LIKE MATERIAL OR SIMILAR PRODUCTS

BACKGROUND OF THE INVENTION

The present invention refers to a pressure container for gases, liquids, paste-like materials or similar products, particularly to an aerosol can. It comprises a plurality of chambers, each chamber being sealed with regard to each other chamber. A plurality of outlet valves, each one of the outlet valves being assigned to one of said chambers, is received and supported in a valve plate. Means are provided for simultaneously operating the outlet valves, and at least one of the chambers is constituted by a flexible bag connected to the valve plate.

Pressure containers of this kind are known in the art; they serve, in the case where two chambers are provided, for the dosed supply of so-called two-component products. However, experience with such pressure containers has shown that it is quite difficult to reliably seal the two chambers against each other in a simple and straightforward manner, particularly to reliably provide an absolutely tight and sealed joint between the flexible bag and the valve plate.

Up to now, the flexible bag has been provided with a tube-like connection piece at the filling and discharge opening of the bag and sealingly fixed thereto, while the other end of the connection piece has been plugged into a extension tube member provided at the valve plate and extending into the interior of the container. For this plug-in connection between connection piece and extension tube member, particularly designed locking and sealing elements are required which are quite expensive. In practice, this solution has not proven to be reliable. Furthermore, the above mentioned locking and sealing elements are quite costly and complicated if they have to meet the strict requirements

OBJECTS OF THE INVENTION

It is an object of the invention to improve a pressure container of the kind mentioned above such that the sealing problem between the two chambers or between a plurality of chambers is solved in a simple, inexpensive and efficient way.

SUMMARY OF THE INVENTION

To meet these and other objects, the invention provides a pressure container for gases, liquids, paste-like materials or similar products, particularly an aerosol can, comprising a plurality of chambers, each chamber being sealed with regard to each other chamber. A plurality of outlet valves, each one of the outlet valves being assigned to one of the chambers, are received and supported in a valve plate Further, means are provided for simultaneously operating the outlet valves;

At least one of the chambers is constituted by a flexible bag connected to the valve plate means which is provided with at least a first extension tube extending into the interior of the pressure container, and the flexible bag or bags comprise a neck portion gas-tightly connected to the extension tube provided on the valve plate.

In this manner, additional locking and sealing elements are not required and the disadvantages in connection with the use of such elements, i.e. expense, manufacturing effort, not reliable sealing etc., are avoided.

In establishing a tight joint between the neck portion of the flexible bag and the extension tube member provided on the valve plate, certain difficulties can arise due to the fact that the neck portion of the flexible bag, upon engaging the extension tube member and particularly during pressing the neck portion of the flexible bag against the outside of the extension tube member, the neck portion of the flexible bag forms wrinkles with the result that leaks could occur. However, this problem can easily be solved by intentionally producing folds on certain places of the neck portion of the flexible bag and sealing these folds right there. For this purpose, the outer shape of the extension tube can comprise at least one radially extending projection, preferably two radially extending projections, which is and are, respectively, bounded by two outer faces each, and which, at their inner ends, merge tangentially into the circle-shaped contour of the extension tube and converge into a sharp edge at their outer ends. By correspondingly shaping the tool pressing the neck portion of the flexible against the extension tube member, a reliable seal between the neck portion of the flexible bag and the extension tube member can be realized in this manner.

If the pressure container is used in its upright position, i.e. with the outlet valves at the top, it is necessary to provide a stand pipe for the complete emptying of the outer chamber of the pressure container. However, if the pressure container is always used in the reverse position, i.e. with the outlet valves at the bottom, the provision of a stand pipe may be superfluous. In order to provide for a stand pipe as one chooses, the valve plate may comprise a second extension tube which is located in the region of the valve aperture assigned to the outer chamber constituted by the container itself and is adapted to receive a stand-pipe. Thereby, the second extension tube is shorter than the first extension tube means in order to ensure that the pressing tool used for pressing the neck portion of the flexible bag against the first extension tube has free access to the external surface of the first extension tube.

If the pressure container is used in its reversed position, i.e. with the outlet valves at the bottom, the flexible bag can slump down upon gradually emptying it if no special measures are taken. Thereby, a further emptying of the flexible bag would be made more difficult or even impossible. A measure to avoid this problem could consist in that a spacer or separator is provided in the interior of the flexible bag which provides for a certain distance of the closed end of the flexible bag from the valve plate. Such spacer or separator can be plugged into the first extension tube and can e.g. take the form of a simple tube member the wall of which being reduced to half of its circumference except for the part thereof which is plugged into the first extension tube. According to another embodiment, the spacer or separator can be in the form of a rod having a star-like cross sectional shape. In both cases, a sufficiently large aperture for the flow of the content of the flexible bag to the associated outlet aperture in the valve plate can be maintained.

BRIEF DESCRIPTION OF THE DRAWINGS

In the following, an embodiment of the pressure container of the invention will be further described, with reference to the accompanying drawings, in which.

DETAILED DESCRIPTION OF PREFERRED EMBODIMENT

Figure 1:
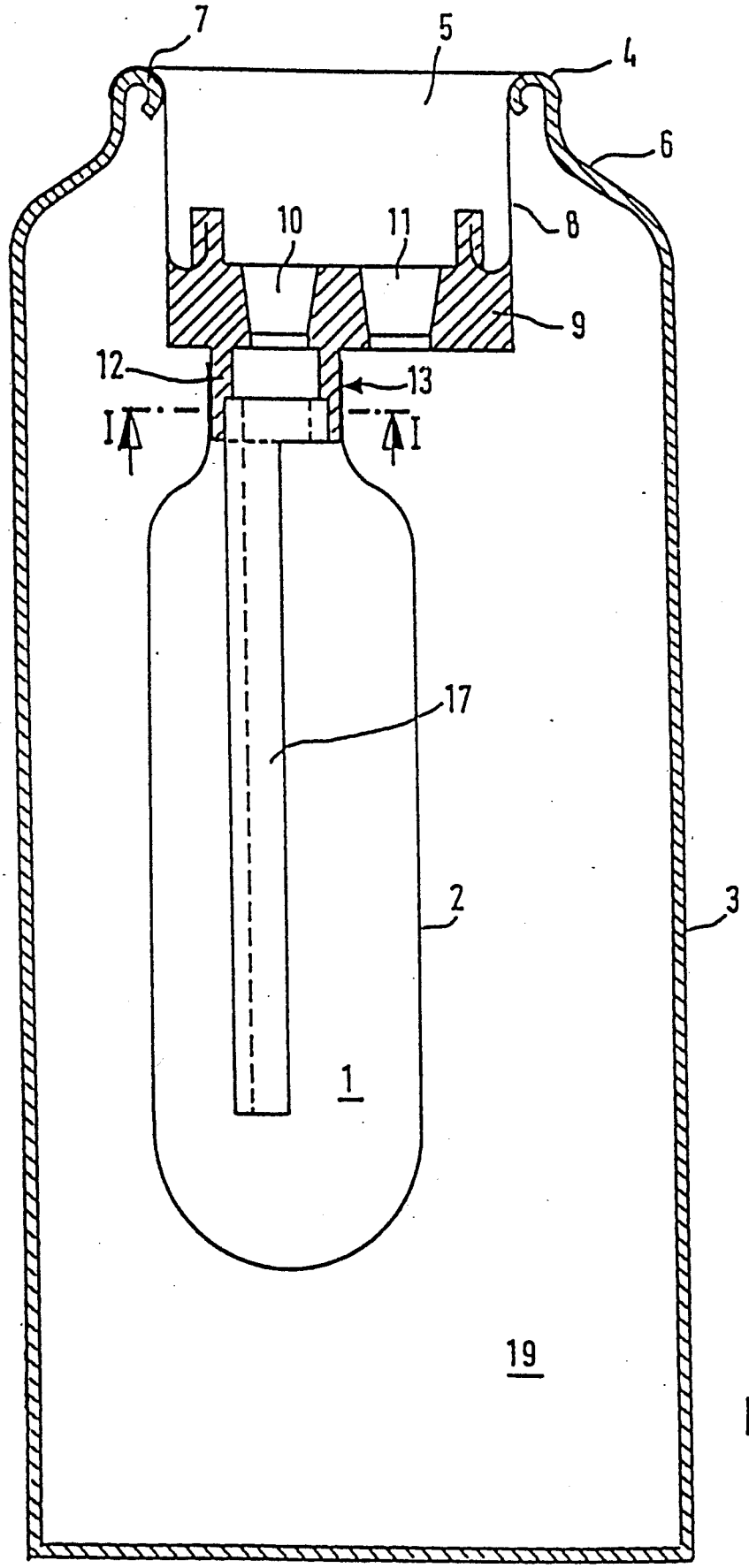
FIG. 1 shows an embodiment of the pressure container according to the invention in a longitudinal sectional view whereby the valve members and the operating member associated therewith are omitted.

The pressure container for gases, liquids, paste-like materials or similar products according to the invention is a so-called multi-chamber container. In the present example, the container comprises in its interior two chambers which are sealed with regard to each other. Particularly, the container 3 comprises, as can be seen from FIG. 1, a first outer chamber 19 which is delimited by the wall of the container 3 itself and a second chamber 1 which is constituted by a flexible bag 2; the second chamber 1 is located in the interior of the pressure container 3.

The container 3 comprises an upper edge portion 4 delimiting a container outlet 5. In the upper edge portion 4 of the container 3, there is provided a cupped annular portion 7 adapted to receive a tube-like insert 8 extending into the interior of the container 3. The tube-like insert 8 is provided with a valve plate 9 at its inner free end. The valve plate 9 is provided with two conically tapered apertures 10 and 11 in which valve members (not shown in the drawings) are to be inserted. Such valve members are known in the art, e.g. disclosed in the European Patent No. 0,111,089; in the same publication, the operating member for simultaneously operating the two valve members are disclosed.

At the inner end of the aperture 10, i.e. at the end having a smaller diameter than the other end, there is provided a extension tube member 12 extending into the interior of the pressure container 3. The flexible bag 2 is sealingly fixed to the extension tube member 12. For this purpose, the flexible bag 2 is provided with a neck portion 13 as can be clearly seen in FIG. 1. To sealingly fix the neck portion 13 of the flexible bag 2 with the extension tube member 12, the neck portion 13 is glued or welded to the extension tube member 12. Thereby, a gas-tight joint is realized which meets the highest demands.

Figure 2:
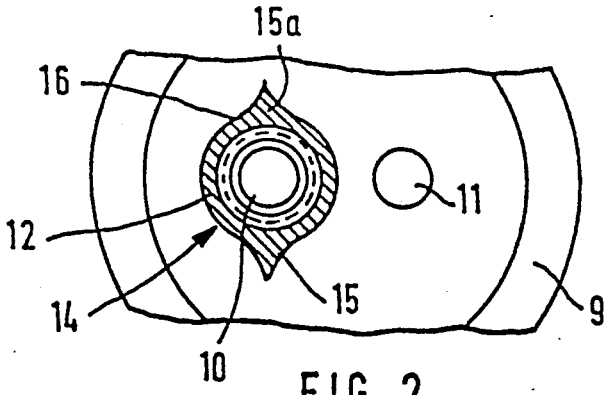
FIG. 2 shows a partial sectional view along the line I—I in FIG. 1.
Figure 4:
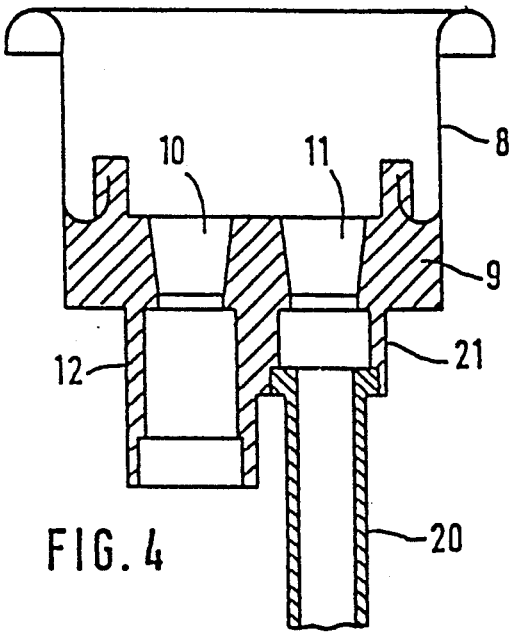
FIG. 4 shows another embodiment of a valve plate in a partial sectional view, adapted to receive a plugged-in stand-pipe.
Figure 5:
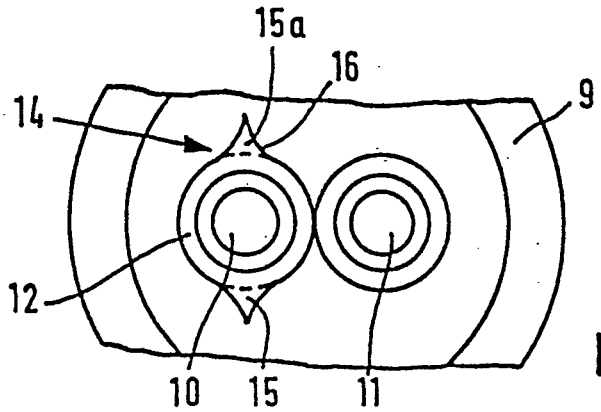
FIG. 5 shows a partial view of the valve plate according to FIG. 4 from the bottom.

It is important that no folds are present in the neck portion 13 of the flexible bag 2 during gluing or welding the neck portion 13 to the extension tube member 12 because, in that case, the gas-tight joint would be impaired. In order to avoid the possibility that folds could occur in the neck portion 13 of the flexible bag 2, the extension tube member 12 has an outer shape as shown in FIGS. 2 and 4. Accordingly, the outer contour 14 of the extension tube member 12 is provided with at least one, but preferably two radially extending projections 15 and 15*a*. The projections 15 and 15*a*, respectively, is bounded by two outer faces 16. At their inner ends, the outer faces 16 merge tangentially into the circularly shaped outer contour of the extension tube member 12, and at their outer ends, the outer faces 16 of the radially extending projections 15 and 15*a* converge into a sharp edge. This design avoids the generation of folds in the neck portion 13 of the flexible bag 2 and ensures an absolutely gas-tight joint between flexible bag 2 and extension tube member 12.

Figure 3:
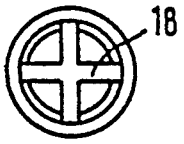
FIG. 3 shows another embodiment of a spacer or separator in a cross-sectional view.

As can be further seen from FIG. 1, there is provided a spacer or separator member 17 located in the interior of the flexible bag 2 and which is plugged-in into the extension tube member 12. The spacer or separator member 17 may be designed as a tube-like element whose outer wall is reduced to not more than half the circumference of the tube-like element, except in that portion where it is plugged-in into the extension tube member 12. According to another embodiment, the spacer or separator can be designed as a rod-like member 18 having a star-shaped cross section as shown in the cross-sectional view of FIG. 3.

The provision of a spacer or separator 17 and 18, respectively, is imperative in such applications in which the pressure container 3 is not used in the position shown in FIG. 1, but in its reverse position, i.e. with the outlet opening 5 of the container 3 downwards. Without the provision of a spacer or separator 17 and 18, respectively, the flexible bag 2 would gradually slump down during the emptying of the flexible bag 2; in this case, the further taking of material from the flexible bag 2 would be made more difficult or even impossible.

If the pressure container 3 is used in its upright position, as shown in FIG. 1, it is necessary to provide a stand pipe 20 for the complete emptying of the outer chamber 19 surrounding the flexible bag 2; thereby, the stand pipe can be inserted, during manufacture of the container 3, only if necessary. For this purpose, the valve plate 9 is provided with a second extension tube member 21 which is connected to the above mentioned second tapered aperture 11 provided in the valve plate member 9. The second extension tube member 21 is considerably shorter than the first extension tube member 12 in order to achieve that the first extension tube member 12 is freely accessible from all sides during the fixing of the neck portion 13 of the flexible bag 2 to the first extension tube member 12.

The pressure container described above is very well suited for the dosed application of two-component products, e.g. a chemically hardening foam, where the foam material itself is contained in the outer chamber 19 and the curing agent in the inner chamber 1 constituted by the flexible bag 2. The design according to the invention ensures a reliable sealing between the two chambers 19 and 1.

What is claimed is:

1. Pressure container for gases, liquids, paste-like materials or similar products, particularly aerosol can, comprising:

a plurality of chambers, each chamber being sealed with regard to each other chamber;

a plurality of outlet valves, each one of said outlet valves being assigned to one of said chambers;

a valve plate means adapted to receive and support said outlet valves;

means for simultaneously operating said outlet valves;

at least one of said chambers being constituted by a flexible bag connected to said valve plate means;

said valve plate means being provided with at least a first extension tube means extending into the interior of said pressure container and said at least one flexible bag comprising a neck portion gas-tightly connected to said first extension tube means.

2. Pressure container according to claim 1 in which said neck portion of said flexible bag is sealingly connected to said extension tube means by gluing or welding.

3. Pressure container according to claim 1 in which the outer shape of said extension tube means comprises at least one radially extending projection, preferably two radially extending projections, which is and are, respectively, bounded by two outer faces each, and which, at their inner ends, merge tangentially into the circle-shaped contour of said first extension tube means and converge into a sharp edge at their outer ends.

4. Pressure container according to claim 1 in which said valve plate means comprises a second extension tube means which is located in the region of the valve aperture assigned to the outer chamber constituted by the container itself, said second extension tube means being shorter than said first extension tube means and being adapted to receive a stand-pipe means.

5. Pressure container according to claim 1 in which a spacer or separator is provided in the interior of said flexible bag which ensures that the closed end of said flexible bag is kept in a certain distance from said valve plate means.

6. Pressure container according to claim 5 in which said spacer or separator is plugged-in.

7. Pressure container according to claim 6 in which said spacer or separator is constituted by a tube member the wall thereof being reduced to half of its circumference except for the part thereof which is plugged into said first extension tube member.

8. Pressure container according to claim 6 in which said spacer or separator is constituted by a rod with a star-shaped cross section.

* * * * *